US008201427B1

(12) United States Patent
Anderson

(10) Patent No.: US 8,201,427 B1
(45) Date of Patent: Jun. 19, 2012

(54) LOCK HOUSING

(75) Inventor: Ron Anderson, Burlington, KY (US)

(73) Assignee: Millenium Metals, Inc., Burlington, KY (US)

( * ) Notice: Subject to any disclaimer, the term of this patent is extended or adjusted under 35 U.S.C. 154(b) by 223 days.

(21) Appl. No.: 12/794,696

(22) Filed: Jun. 4, 2010

(51) Int. Cl.
*E05B 65/46* (2006.01)
*E05B 37/00* (2006.01)

(52) U.S. Cl. ..... 70/85; 70/86; 70/88; 70/284; 70/285; 70/332; 70/333 R; 70/333 A; 70/370; 70/371; 70/443; 70/451

(58) Field of Classification Search ..... 70/332, 70/333 R, 333 A, 334, DIG. 43, DIG. 56, 70/DIG. 63, DIG. 71, 442–446, 77–88, 21, 70/284, 285, 367–371, 417, 451, 466; 109/47
See application file for complete search history.

(56) References Cited

U.S. PATENT DOCUMENTS

| | | | | | |
|---|---|---|---|---|---|
| 274,346 | A | | 3/1883 | Laubenberger | |
| 732,197 | A | | 6/1903 | Lietz | |
| 1,042,838 | A | * | 10/1912 | Taylor | 70/445 |
| 1,362,417 | A | * | 12/1920 | Hammer | 70/285 |
| 1,645,579 | A | * | 10/1927 | Billingsley | 70/304 |
| 1,898,241 | A | * | 2/1933 | Carlson | 70/285 |
| 1,909,453 | A | * | 5/1933 | Brown | 70/445 |
| 2,062,067 | A | | 11/1936 | Miller | |
| 2,726,625 | A | | 12/1955 | Evans | |
| 2,858,692 | A | * | 11/1958 | Deaton et al. | 70/332 |
| 3,031,876 | A | * | 5/1962 | Foote et al. | 70/285 |
| 3,446,046 | A | * | 5/1969 | Randel | 70/101 |
| 3,482,422 | A | * | 12/1969 | Cornwell, Jr | 70/78 |
| 3,508,423 | A | * | 4/1970 | Harrell et al. | 70/78 |
| 3,633,388 | A | * | 1/1972 | Atkinson | 70/80 |
| 3,920,297 | A | * | 11/1975 | Brandes | 312/217 |
| 4,041,741 | A | | 8/1977 | Cintron | |
| 4,369,993 | A | * | 1/1983 | Rodriguez | 292/148 |
| 4,509,350 | A | | 4/1985 | Gartner | |
| 5,047,599 | A | | 9/1991 | Giolli | |
| 5,257,520 | A | | 11/1993 | Miller | |
| D345,094 | S | | 3/1994 | Miller | |
| 5,305,695 | A | | 4/1994 | Lichter | |
| 5,946,954 | A | * | 9/1999 | Emery et al. | 70/213 |
| 6,058,745 | A | | 5/2000 | Sanchez | |
| 6,412,317 | B1 | * | 7/2002 | Martin | 70/81 |
| 7,357,242 | B2 | | 4/2008 | Enomoto | |
| 7,444,844 | B1 | * | 11/2008 | Lee | 70/21 |
| 8,091,392 | B2 | * | 1/2012 | Miller et al. | 70/333 A |

* cited by examiner

*Primary Examiner* — Lloyd Gall
(74) *Attorney, Agent, or Firm* — Middleton Reutlinger; James E. Cole; John F. Salazar

(57) ABSTRACT

A lock housing for a security drawer is disclosed. The lock drawer system includes a cabinet drawer having a front wall including a front surface and a rear surface and a combination lock on the drawer with a combination lock dial. The drawer includes a lock housing defining an enclosure within which the dial can fit and extend through. The lock housing also includes a combination lock dial window. The system integrates a keyed locking bolt extending through the housing and to the drawer and is removable therefrom.

15 Claims, 6 Drawing Sheets

LOCK HOUSING

CROSS-REFERENCE TO RELATED DOCUMENTS

None.

TECHNICAL FIELD

The present invention relates to housings for safes having combination locks. More particularly, the invention provides a housing which inhibits access to the combination lock by drilling through a housing or cabinet door underneath the lock and deactivating the lock structure without leaving visible indication of tampering of the lock.

BACKGROUND

Numerous attempts have been made to develop covers or protective devices for combination locks utilized with safes and drawers. These are desirable to limit or inhibit a thief's access to the dial or the lock mechanisms utilized with the dial.

According to Federal Specification AA-F-358H, access to a combination lock may be gained by pulling out the dial assembly which is held in place with a snap ring. Removal of the dial assembly provides access to the screws that mount the dial ring assembly on the door. Thus, after removal of the snap ring then dial ring assembly through said screws, access to the interior of the enclosure may be obtained by drilling through the safe or cabinet door behind the dial ring after such removal. After access, the dial ring may and spindle assembly may be replaced without visual indication of tampering or access. Accordingly, a brief visual inspection does not immediately reveal that a break-in or breach has occurred. It would be preferable that a brief visual inspection of the drawer would immediately indicate that a breach of security has occurred.

The prior art combination lock drawers have utilized welded plates to cover portions of the combination lock structure. Covering portions of the combination lock inhibits tampering with the lock in order to inappropriately access contents of the safe. Unfortunately, when welding hard face material, which typically contains tungsten carbide chips, directly to the front of the lock or safe door, the welding can distort the box and inhibit lock installation or proper operation. While these types of plates prolong entry to the cabinet, they often do not prohibit entry.

According to time limitations of the Federal Specification, the only alternative would be cut lock bolts by cutting through the lock door of the safe or cabinet and replacing with a new front door or drawer and new lock bolts. This is much more labor intensive and fails to meet the time restrictions of the Federal Specification.

It would be highly desirable to develop a combination lock protector which requires such activity that access to the combination lock fails to meet time restrictions of the federal guidelines. It would also be highly desirable to inhibit non-visible entry of the safe or drawer, so that tampering indication is clearly evident upon a brief or preliminary visual inspection of the drawer or safe.

SUMMARY

The present disclosure is directed towards a lock housing for a security drawer which includes a combination lock and a lock dial, the lock dial having a lock housing enclosing the dial and being removable by a keyed locking bolt extending through the housing and to or into the drawer. In various embodiments, the locking bolt may retain the housing in appropriate relationship against the drawer by multiple constructions. In one embodiment, the invention relates to a lock housing for a security drawer having a cabinet drawer having a front wall including a front surface and a rear surface, a combination lock disposed on the drawer and a combination lock dial disposed on the front wall of the drawer, the lock housing defining an enclosure, the lock housing having a front surface including a dial aperture and a lock aperture, the lock housing further having a plurality of sides, the lock dial passing through the dial aperture on the front surface of the lock housing. In other embodiments, one of the side surfaces may include a combination lock dial window. In other constructions, a keyed locking bolt may be provided extending through the lock aperture of the lock housing and engage threads disposed either one of within said cabinet drawer or on a rear surface of the drawer.

In other embodiments, a portion of the keyed locking bolt is rotatable with a key. In other embodiments, the lock housing dial aperture can be substantially circular in shape.

In a further embodiment, a lock housing for a security drawer is disclosed including a drawer having a storage cavity and a front drawer enclosure, a combination lock having a dial disposed on the front drawer enclosure, a lock mechanism on one of a rear surface of the front drawer enclosure or within the front drawer enclosure, a lock housing disposed on the front drawer enclosure, the lock housing having a front surface and a dial aperture in the front surface, the dial aperture receiving the dial therethrough, a keyed bolt aperture in the front surface of the lock housing, a keyed locking bolt extending through the lock housing from a front surface of said lock housing through said front drawer enclosure, the keyed locking bolt retaining the lock housing on the front drawer enclosure, wherein the lock housing having a window revealing numbers on the combination lock dial.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE ILLUSTRATIONS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
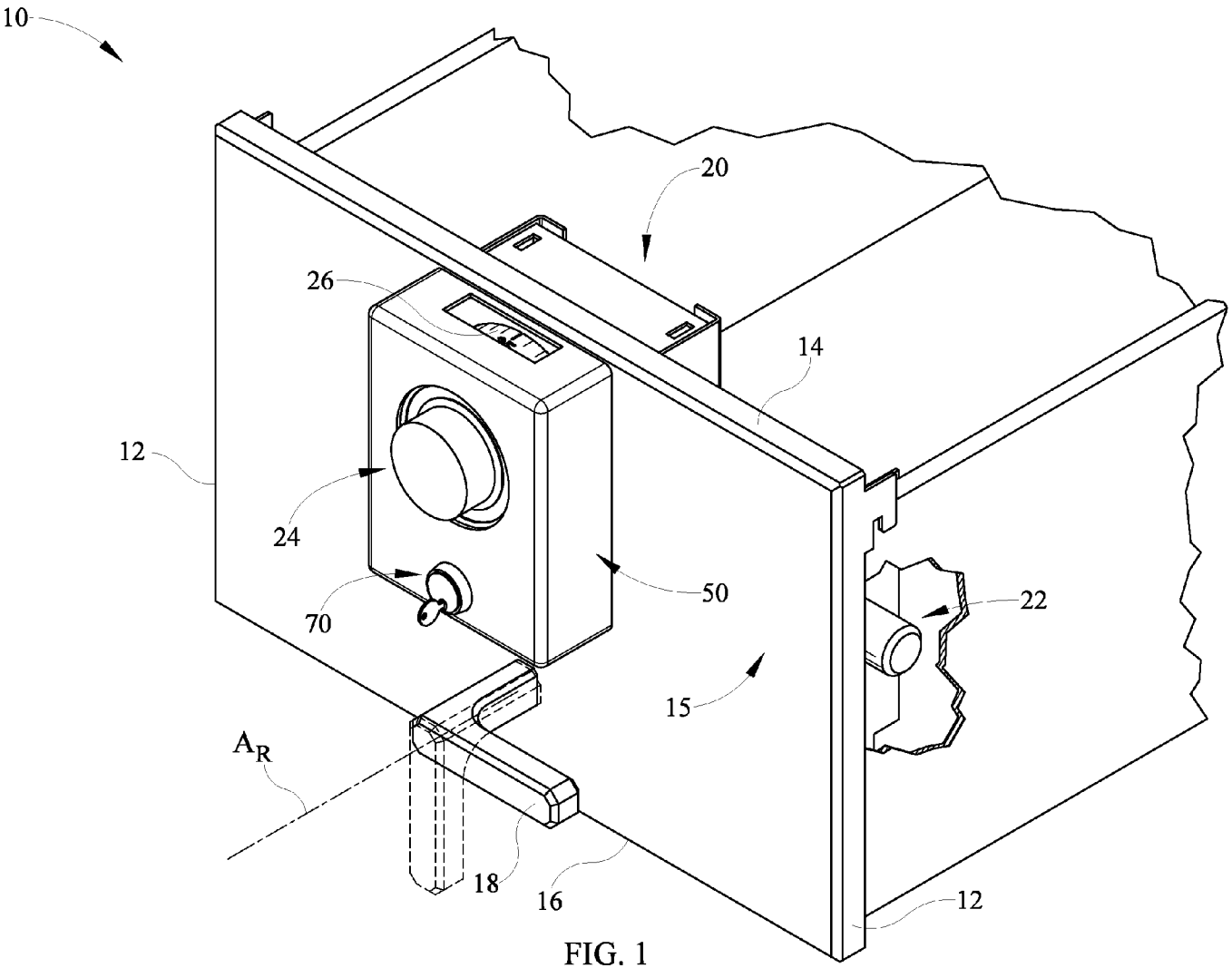
FIG. 1 depicts a perspective view of a security drawer including a combination lock housing.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

It will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the claimed invention.

A security drawer for retaining confidential information is shown in the various FIGS. 1-5. The security drawer utilizes a combination lock having a lock housing to inhibit access to the combination lock and inappropriate access to the drawer. The lock housing inhibits positioning of a drill near the combination dial to deactivate the lock. Further, the lock housing provides immediate visual indication of damage if the lock housing has been inappropriately breached in order to gain access to the lock mechanism.

Referring initially to FIG. 1, a perspective view of a security drawer 10 is depicted. A drawer 10 has front face or enclosure 15 having a top edge 14, a bottom edge 16 and two opposed side edges 12 extending between the top and bottom edges 14, 16. The front face or enclosure 15 includes a front surface or wall and a rear surface (not shown) extending between the edges. The drawer 10 further comprises additionally surrounding walls which, in combination with the front face or enclosure, define a cavity wherein confidential files may be stored.

Extending from the front surface 15 of the drawer 10 is a pull 18. The pull 18 may be utilized to open the drawer 10 once the drawer is unlocked. On the rear surface of the drawer 10 a lock mechanism 20 is disposed with a lock bar 22 extending from at least one side 12 of the drawer 10. The lock mechanism 20 engages or disengages the lock bar 22 with adjacent structure in order to inhibit opening of the drawer 10. The pull 18 may be pivotable to allow rotation when the combination lock mechanism 20 is unlocked to extend or retract the lock bar 22. As shown, the pull 22 would rotate about an axis $A_R$.

Still referring to FIG. 1, a combination lock dial 24 is shown extending from the front surface 15 of the drawer 10. The dial 24 is utilized to lock and unlock the lock mechanism 20. The dial 24 is rotatable about an axis which is parallel to $A_R$ to adjust tumblers within the lock mechanism 20 to either engage or disengage the lock bar or linkage 22 to a locked extended or unlocked retracted position.

One skilled in the art will understand the operation of a lock mechanism. Accordingly, the following is provided merely for exemplary purpose and should not be considered limiting. The dial 24 is connected to a spindle 28 (FIG. 2) and the spindle is connected to a drive cam (not shown). Rotation of the spindle 28 causes rotation of the drive cam and one or more wheels or cams. These wheels or cams utilize wheel dogs which are engaged by the drive cam or adjacent wheel dogs to cause rotation of the wheels. Each of the wheels has a notch which are unaligned when the mechanism is in a locked position. During a preselected sequence of rotations in either or both of the clockwise or counter-clockwise directions, notches in the wheels become aligned so that a fence falls into the aligned notches and allows for movement of a slide to unlock the drawer lock bar 22.

The dial 24 includes a plurality of numbers 26 along an upper side of the dial assembly. The numbers allow for adjustment of the combination lock dial 24 to preselected locations in order to unlock the mechanism 20. The dial 24 is shown having a first cylindrical portion of a first larger diameter and a second cylindrical portion extending from the first portion and having a smaller diameter. Along the rear surface of the dial 24, an aperture may be disposed for receiving the spindle 28.

Figure 2:
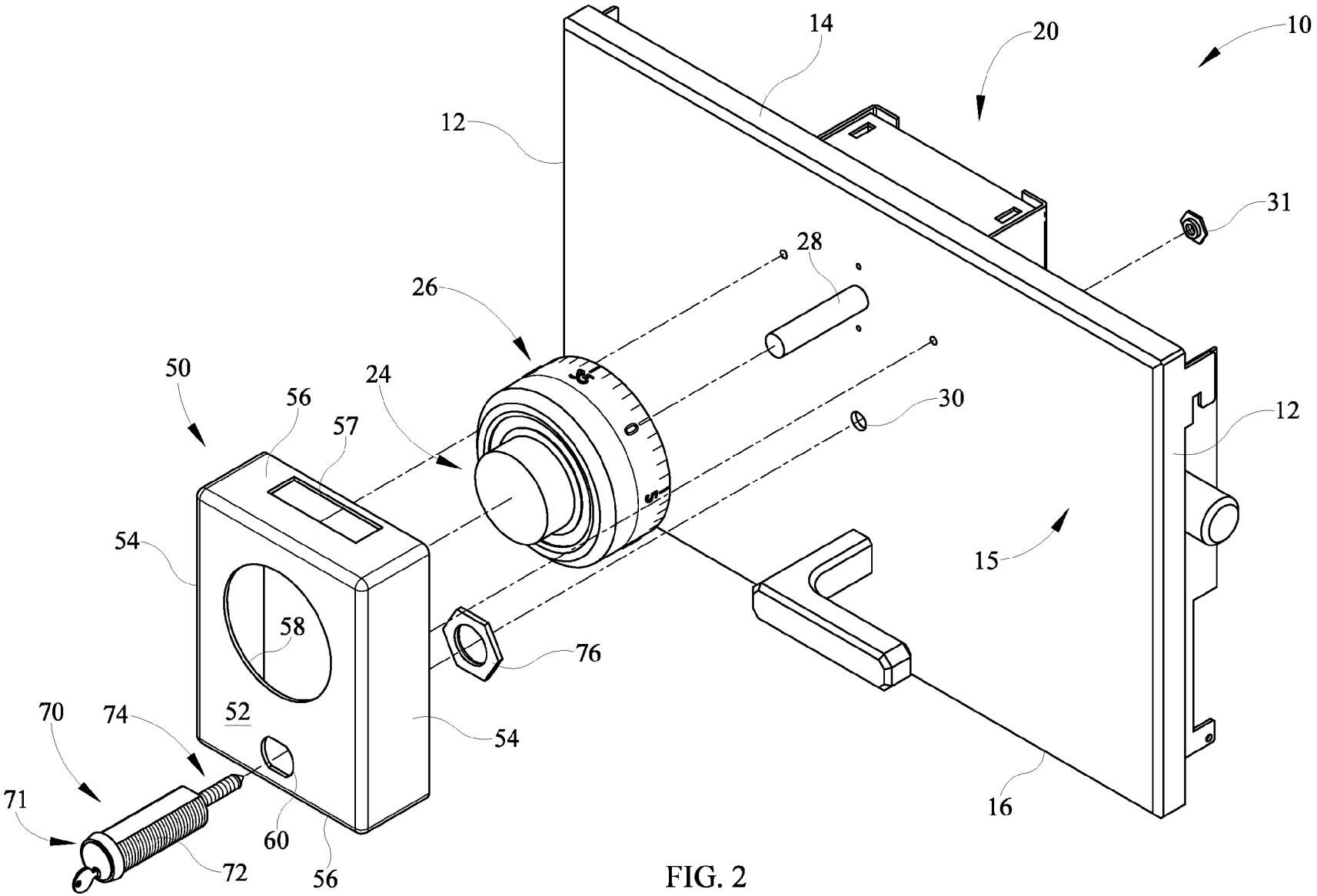
FIG. 2 depicts an exploded perspective view of the drawer face of FIG. 1 with the lock housing exploded.

Referring now to FIG. 2, an exploded perspective view of the drawer 10 is depicted. With the dial 24 exploded from the drawer front surface 15, the dial shaft or spindle 28 is revealed. The spindle 28 includes, and is part of, the lock mechanism 20 for locking and unlocking the drawer. Rotation of the dial 24 causes rotation of the spindle 28 and the elements within the lock mechanism 20.

Additionally, with the dial 24 exploded, a bolt aperture 30 is shown. The aperture is shown to be oblong in shape. However, the aperture may also be circular depending on the type of bolt utilized and the shape of the structures passing there through. Adjacent the bolt aperture 30 is a pem nut 31 which is pressed into either the front surface 15 or rear surface of the front drawer face. The pem nut 31 is received by the drawer face 15 and utilizes serrated edges or teeth to inhibit rotation of the nut once the nut is pressed into the drawer 10. The pem nut 31 receives a threaded portion 74 of the keyed bolt 70. Accordingly, the diameter and thread count of the threaded portion 74 corresponds to the diameter and thread count of the pem nut 31. As an alternative, various types of nuts may be utilized. For example a nut may be welded to the rear surface of the front enclosure. Additionally, a compression spring or alternate tensioning structure may be positioned on the keyed bolt 70 to retain the bolt 70 in a tight connection with the front enclosure of drawer 10.

Exploded from the drawer 10 and dial 24 is a lock housing 50. As shown in FIGS. 1 and 2, the lock housing 50 is generally rectangular in shape having a front surface 52 and a plurality of side surfaces 54, 56. Although the shape of the housing is described as rectangular, this is merely exemplary and should not be considered limiting as various shapes may be used. The vertical sides 54 extend between the horizontal top and bottom sides 56. The lock housing 50 may be formed of various materials including metallics and non-metallics. Additionally, and merely as non-limiting examples, the materials may be machined, die cast, or molded metallics or non-metallics. The lock housing 50 further comprises a dial aperture or access window 58 disposed on the front surface 52. The dial aperture 58 receives the dial 24 there through, so that the dial 24 extends through the opening 58 and may be rotated, with the lock housing 50 in position to open or close the drawer 10. The upper surface 56 includes a window 57 which is defined by an aperture within the upper surface 56. The aperture or window 57 allows visual recognition of the indications of the dial register 25 so that the dial 24 may be turned appropriately to lock or unlock the system. The window 57 is shaped in a generally rectangular shape however, the window 57 may be any shape which allows a user to see the numbers 26 on the dial 24.

The lock housing 50 further comprises a keyed-bolt aperture 60. The keyed-bolt aperture or lock access window 60 receives the keyed-bolt 70 which passes through the lock housing 50.

The threaded bolt 70 includes a first threaded portion or fastener 72 of a larger diameter and a second threaded portion or fastener of a smaller diameter 74. Although the exemplary bolt 70 utilizes differing diameter portions, the bolt may comprise two thread portions of same diameter or same diameter but differing thread counts or reversed threads, for example. The first larger threaded portion includes rounded edges and parallel upper and lower edge connecting the threaded rounded edges. The first threaded portion 72 is engaged by a nut or fastener receiver 76 to retain the threaded bolt 70 against the housing 50. This smaller threaded portion 74 rotated within the larger portion 72 threadably engages the pem nut 31, disposed in the aperture 30 of the drawer 10, to connect the keyed-bolt 70 to the drawer 10. Rotation of a key of keyed lock 71 in a first direction disposed in the bolt 70 on the outer surface 15 of the drawer enclosure causes rotation of the threaded portion 74 to engage the nut 31, such as a pem nut. Rotation in the opposite direction causes removal of threaded portion from the nut 31, and allows removal of the housing 50 from the surface 15 of the front drawer enclosure.

The keyed-bolt 70 is utilized to affix or retain the lock housing 50 against the outer surface 15 of the drawer 10. This precludes removal of the lock housing 50 to improperly deactivate or remove the dial 24 and deactivate the locking mechanism 20. Per the federal specifications for confidential drawers, such as drawer 10, the lock mechanism 20 cannot be accessed within a thirty minute period and must visibly indicate tampering or damage immediately upon review of the drawer surface 15.

Figure 3:
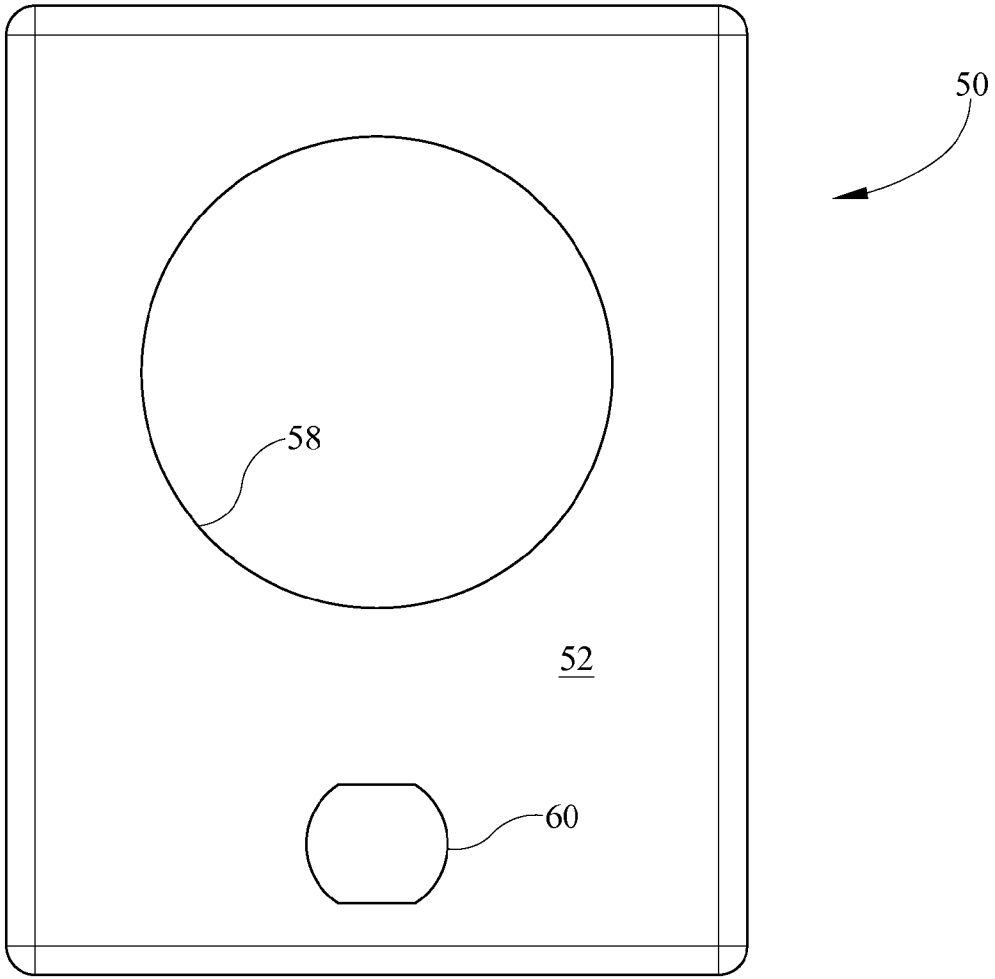
FIG. 3 depicts a front view of a lock housing.

Referring now to FIG. 3, a front view of the lock housing 50 is shown. The lock housing has a front surface 52 which may be generally rectangular in shape. However, alternative shapes may be utilized as well, and therefore the depicted shape should not be considered limiting. Additionally, within the front surface 52 is the dial aperture 58 which is shown as circular. The shape may vary depending on the shape of the dial 24 (FIG. 2). The corners where surfaces 52, 54 and 56 join may be radioed, chamfered, sharp or other geometric formations. According to the exemplary embodiment, the corners are radiused at least in part to eliminate sharp edges and injury which may occur due to contact with such.

Still referring to FIG. 3, the keyed-bolt aperture 60 is oblong in shape and referred to in the art as a double-D opening. This allows for placement of the correspondingly shaped key-bolt 70. The upper and lower edges of the oblong-shape are parallel and correspond in size to the parallel edges of the keyed bolt 70. The parallel edges of the aperture 60 inhibit rotation of the larger threaded portion 72 of the keyed-bolt 70 once inserted through the lock housing 50. With the keyed bolt stationary, the nut 76 may be threadably positioned on the larger bolt portion 72 to tighten and retain the bolt 70 within and against the housing 50.

Figure 4:
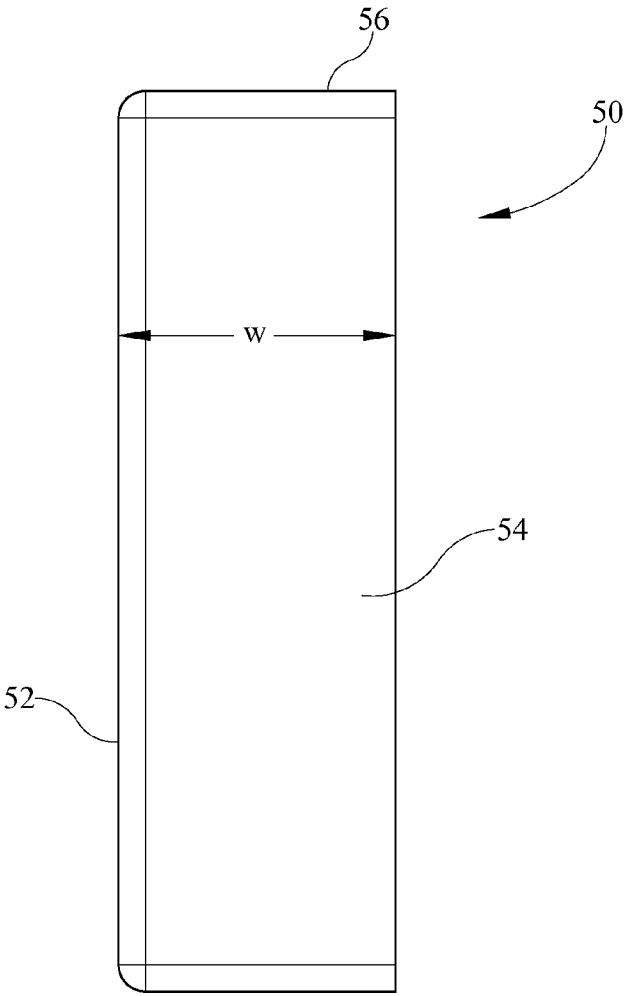
FIG. 4 depicts a side view of a lock housing.

Referring now to FIG. 4, a side view of the lock housing 50 is depicted. The side 54 is shown as also being rectangular in shape. It has a width W which is related to the depth of dial 24. One skilled in the art will recognize that the width W should be of sufficient distance to allow the dial 24 to at least partially extend through the housing 50 for operation of the dial when the lock housing 50 is disposed over the dial 24.

Figure 5:
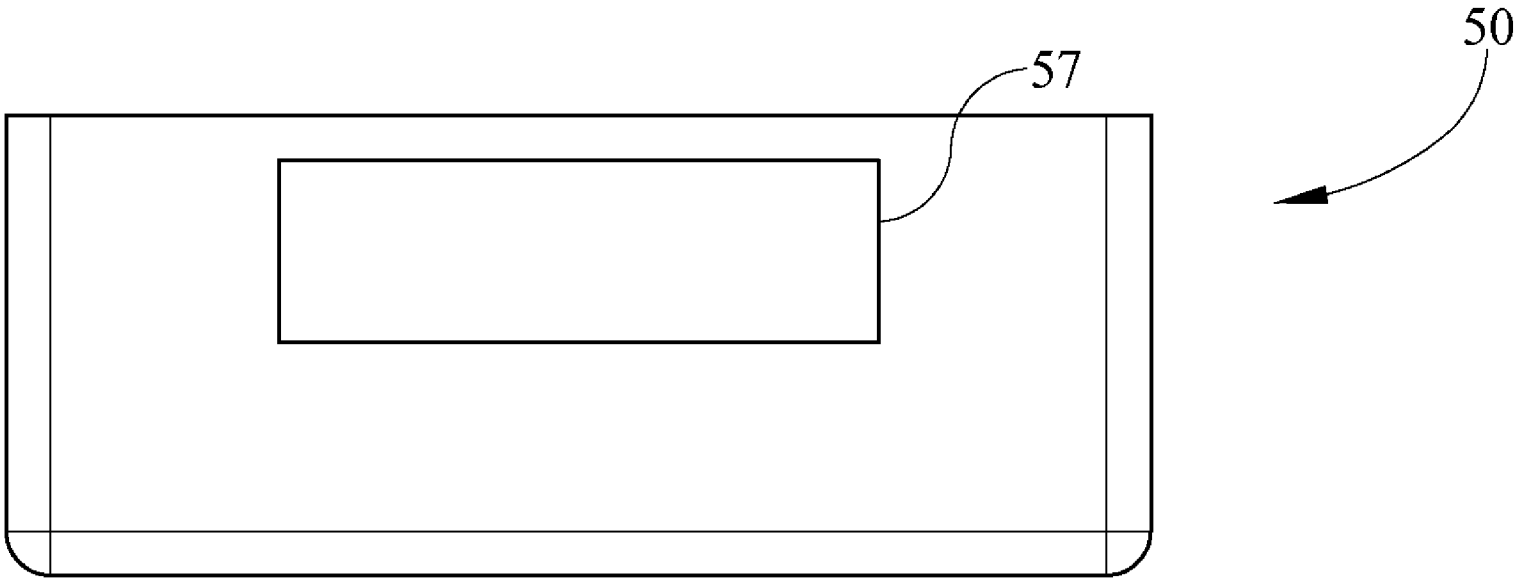
FIG. 5 depicts a top view of a lock housing.
Figure 6:
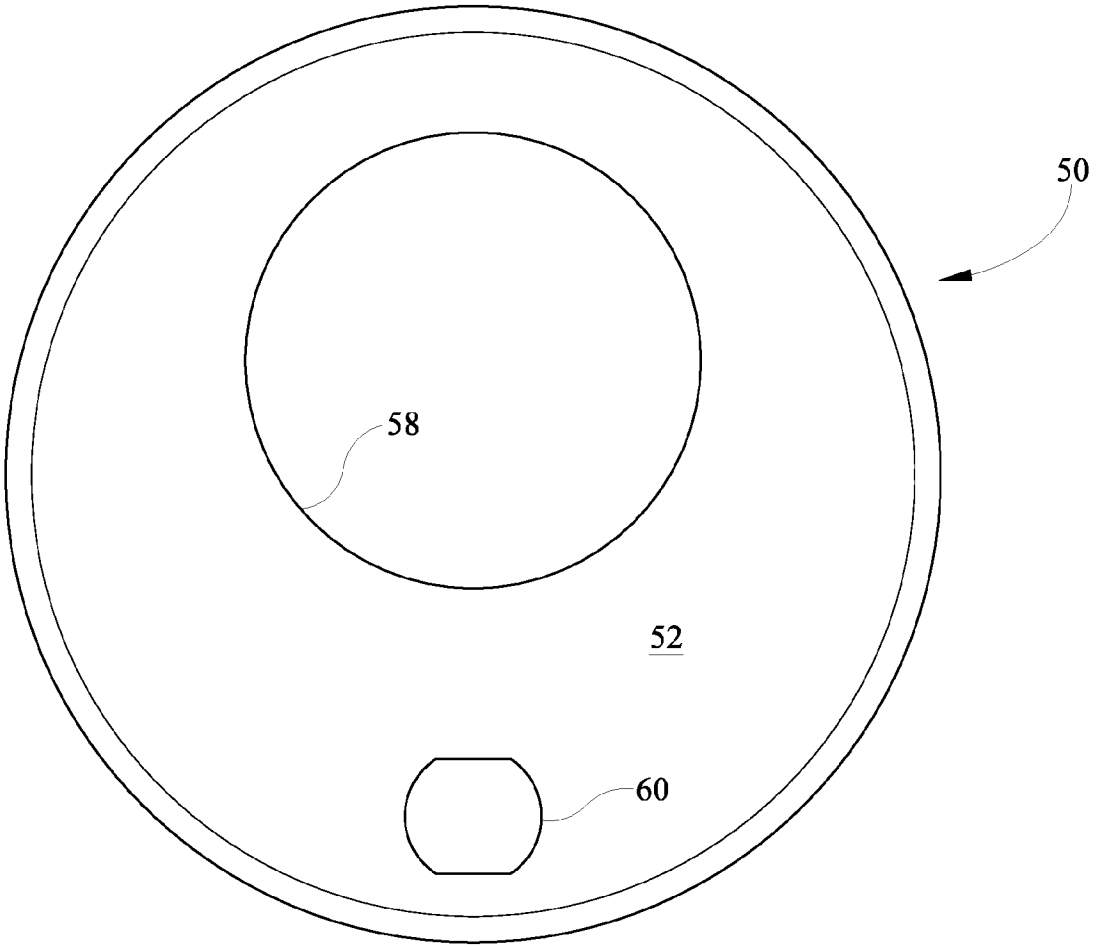
FIG. 6 depicts front view of an alternate lock housing embodiment.

Referring now to FIG. 5, a top view of the lock housing 50 is depicted. The upper surface 56 includes a window aperture 57 which allows visual recognition of the dial register 26 (FIG. 2) beneath the window. Thus, the housing 50 does not inhibit use of the dial 24 during operation of the lock mechanism 20.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, any reference numerals or other characters, appearing between parentheses in the claims, are provided merely for convenience and are not intended to limit the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A security enclosure, comprising;

a drawer having a front face;

a combination lock disposed on said drawer and a rotatable combination lock dial disposed on said front face of said drawer;

a lock housing defining an enclosure and having a front surface including a dial access window and a lock access window;

said combination lock dial passing through said dial access window on said front surface of said lock housing;

a keyed locking bolt extending through said lock access window of said lock housing and removably engaged to said drawer;

wherein said keyed locking bolt has a second threaded portion extending from a first threaded portion, said second threaded portion connected to a keyed lock, whereby rotation of said keyed lock correspondingly rotates said second threaded portion while said first threaded portion remains non-rotatably positioned within said lock access window of said lock housing allowing removal of said keyed locking bolt from said drawer and said lock housing;

said lock housing removable from said drawer after rotational removal of said keyed locking bolt.

2. A security drawer, comprising;

a cabinet drawer having an enclosure including a front surface and a rear surface;

a combination lock disposed on said drawer and a combination lock dial disposed on said enclosure of said cabinet drawer;

a lock housing defining an enclosure, said housing having a front surface including a dial aperture and a lock aperture, said lock housing further comprising a plurality of side surfaces;

said combination lock dial passing through said dial aperture on said front surface of said lock housing;

one of said side surfaces including a combination lock dial window;

a keyed locking bolt extending through said lock aperture of said lock housing and engaging threads disposed either one of within said cabinet drawer or on said rear surface of said cabinet drawer.

3. The security drawer of claim 2 further comprising said combination lock having a plurality of dial numbers on a surface of said dial.

4. The security drawer of claim 3, said combination lock dial window revealing said plurality of dial numbers for operation of said combination lock.

5. The security drawer of claim 2, said combination lock dial window formed by an opening in an upper side surface of said lock housing.

6. The security drawer of claim 2, a portion of said keyed locking bolt being rotatable with a key.

7. The security drawer of claim 2, said dial aperture being substantially circular in shape.

8. A security safe, comprising:

a drawer including a storage cavity and a front face;

a combination lock having a dial and a locking linkage actuatable between a locked position and an unlocked position, said dial disposed on an outer surface of said drawer;

a lock housing covering a portion of said dial, said lock housing having an opening and said dial extending through said opening;

at least one nut engaging said drawer from a rear surface;

a keyed locking bolt passing through said lock housing and threadably engaging said at least one nut.

9. The security safe of claim 8, said lock housing being generally circular in shape.

10. The security safe of claim 8 said lock housing being generally rectangular in shape.

11. The security safe of claim 8 further comprising a combination window disposed in said lock housing.

12. The security safe of claim 8 at least one fastener of said keyed locking bolt extending through a surface of said front face.

13. The security safe of claim 8, said lock housing formed from the group consisting of: machined, die cast, molded metallic or non-metallic material.

14. The security safe of claim 8 further comprising a fastener receiver disposed in said lock housing.

15. A security drawer, comprising:

a storage cavity and a front drawer enclosure;

a combination lock having a dial disposed on said front drawer enclosure, said combination lock disposed on one of a rear surface of said front drawer enclosure or within said front drawer enclosure;

a lock housing disposed on said front drawer enclosure, said lock housing having a front surface and a dial aperture in said front surface, said dial aperture receiving said dial therethrough;

a keyed bolt aperture in said front surface of said lock housing;

a keyed locking bolt extending from said front surface of said lock housing through said front drawer enclosure, said keyed locking bolt retaining said lock housing on said front drawer enclosure;

said lock housing having a window revealing numbers on said combination lock dial.

* * * * *